US005523934A

United States Patent [19]

Dworman et al.

[11] Patent Number: 5,523,934

[45] Date of Patent: Jun. 4, 1996

[54] COMPOSITE FLOOR LAMP

[75] Inventors: Ralph M. Dworman; Nancy S. Dworman, both of Worcester, Mass.

[73] Assignee: Ralphco, Inc., Worcester, Mass.

[21] Appl. No.: 349,927

[22] Filed: Dec. 6, 1994

[51] Int. Cl.[6] ..... F21S 1/10

[52] U.S. Cl. ..... 362/431; 362/414; 206/223; 206/320

[58] Field of Search ..... 362/414, 413, 362/410, 411, 431; 206/223, 320, 326

[56] References Cited

U.S. PATENT DOCUMENTS

| | | | |
|---|---|---|---|
| 1,256,031 | 2/1918 | Miller | 206/223 |
| 1,456,194 | 5/1923 | Rosenberg | 362/410 |
| 1,802,460 | 4/1931 | Doane | 362/414 |
| 2,246,961 | 6/1941 | Voogt | 362/414 |
| 2,255,262 | 9/1941 | Mac Fadden | 362/413 |
| 2,308,567 | 1/1943 | Reichart | 206/320 |
| 2,570,946 | 10/1951 | Hennessey | 206/320 |
| 5,016,154 | 5/1991 | Leeyeh | 362/414 |

*Primary Examiner*—Carroll B. Dority
*Attorney, Agent, or Firm*—Blodgett & Blodgett

[57] ABSTRACT

A composite floor lamp and container for the floor lamp. The floor lamp includes a main elongated main body, a top assembly which is attached to one end of the main body and a bottom assembly, including a base, which is attachable to the opposite end of the main body. A light bulb and a lamp shade are attachable to the upper end of the top assembly. The container for the disassembled floor lamp includes a box, a partition on one side of the box for holding the main body, a partition on the other side of the box for holding the top assembly, a front spacer and a back spacer. The bottom assembly is supported in an upright position at the bottom of the box between the two partitions and the two spaces and the lamp shade is supported on the bottom assembly in an inverted position.

23 Claims, 7 Drawing Sheets

COMPOSITE FLOOR LAMP

BACKGROUND OF THE INVENTION

The present invention relates to a composite floor lamp, a composite floor lamp package and a container for a composite floor lamp.

A floor lamp must have a substantial length in order to be effective. This length and the bulkiness of the shade require a bulky container. This results in a high shipping and handling cost from the manufacturer to the retailer and in a high storage cost to the retailer. This cost, which is associated with bulkiness of the product, is ultimately passed onto the consumer. The bulkiness of the floor lamp package can be reduced by providing a composite floor lamp which is packaged in a disassembled state and which can be assembled by the consumer. By making the composite floor lamp package more compact, there is a savings in the shipping and handling cost. One disadvantage of this approach is that it represents an inconvenience to the consumer and can result in a damaged product if the consumer is not careful in assembling the lamp. Also, there is an increased likelihood that one or more of the components of the lamp will be damaged during shipment. These and other difficulties experienced with the prior art floor lamps have been obviated by the present invention.

It is, therefore, a principal object of the invention is to provide a composite floor lamp which can be broken down so that the components of the lamp will fit into a relatively small package for shipment.

Another object of the invention is the provision of a composite lamp which can be assembled and disassembled very easily by the consumer.

A further object of the present invention is the provision of a composite floor lamp and container package combination which is compact and which prevents the lamp components from being damaged during shipment.

It is another object of the present invention to provide a composite floor lamp in which the main component of the assembled lamp has the appearance of a crayon.

A still further object of the invention is the provision of a container for a composite floor lamp which prevents damage to the components during shipment.

With these and other objects in view, as will be apparent to those skilled in the art, the invention resides in the combination of parts set forth in the specification and covered by the claims appended hereto.

SUMMARY OF THE INVENTION

The invention consists of a composite floor lamp having a main elongated main body, a top assembly for receiving a light bulb and a shade which is attachable to one end of the main body, and a bottom assembly, including a base, which is attachable to the opposite end of the main body. More specifically, each of the top assembly and the bottom assembly is connected to the main body by a coupler. Each of the upper and lower bodies has a plurality of components which are held together as a unit along with its associated coupler by an elongated threaded fastener. The invention also consists of a composite floor lamp package which includes a box having a pair of opposed and spaced spacers at the bottom wall of the box. Each spacer has an opening adjacent the bottom wall of the box for receiving a portion of the outer periphery of a disk-shaped base which forms part of a bottom assembly of a lamp having a bottom assembly, a top assembly and a main elongated body. The bottom assembly includes an upwardly extending upper portion which extends into a channel which is formed by the interior supporting frame of a lamp shade which forms part of the floor lamp when the lamp shade is inverted and rests on the base of the bottom assembly. One of the spacers has a chamber for receiving the main elongated body. The other spacer has a chamber for receiving the top assembly. The invention also consists of a container for a composite floor lamp which has an outer box structure, a first spacer along the intersection between the bottom and one side wall of the box and a second spacer along the intersection of the bottom wall and the opposite side wall of the box. Each spacer has an opening near the bottom wall of the box which faces the opposite spacer.

BRIEF DESCRIPTION OF THE DRAWINGS

The character of the invention, however, may be best understood by reference to one of its structural, as illustrated by the accompanying drawings in which.

DETAILED DESCRIPTION OF THE PREFERRED EMBODIMENT

Figure 1:
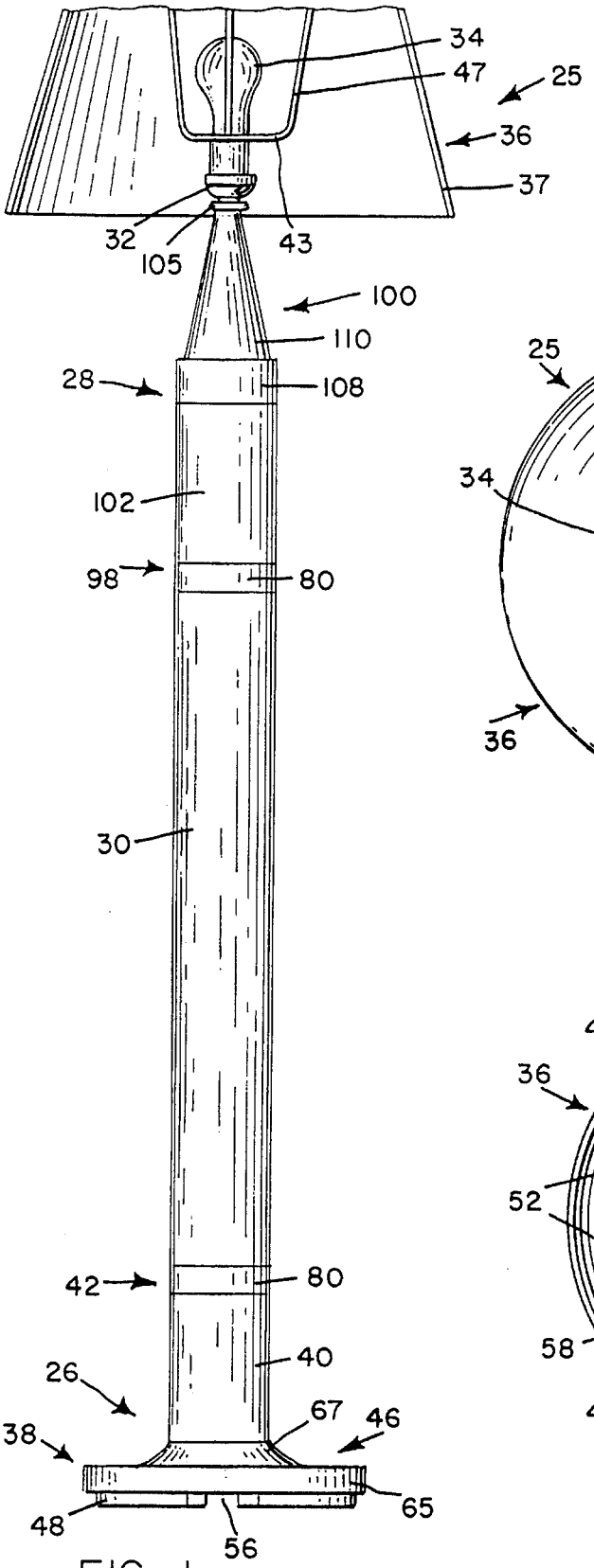
FIG. 1 is an elevational view of a composite floor lamp embodying the principles of the present invention.

Referring first to FIGS. 1–4, the composite floor lamp of the present invention is generally indicated by the reference numeral 25 and comprises a bottom assembly which is generally indicated by the reference numeral 26, a top assembly which is generally indicated by the reference numeral 28 and an elongated main body 30 which is located between the bottom assembly 26 and the top assembly 28. The top assembly 28 includes a light fixture 32 which is fixed to the top of the top assembly for receiving a conventional light bulb 34 and for supporting a lamp shade 36.

The lamp shade 36 comprises a frusto-conical outer wall 37 which has a small diameter opening 39 at the top of the shade and a large diameter opening 41 at the bottom of the shade. The shade 36 has a central fixture which is supported at one end of a wire framework 47. The opposite end of the framework 47 is fixed to the top end of the outer wall 37. The central fixture 43 has a threaded aperture 45 for receiving the upper threaded end of the light fixture 32.

The bottom assembly 26 includes a base which is generally indicated by the reference numeral 38, a first coupler which is generally indicated by the reference numeral 42, a cylindrical, tubular lower body 40 which is located between the first coupler 42 and the base 38 and an elongated tubular, threaded rod 44. The base 38 comprises a housing 46 which is shown in greater detailed in FIGS. 10–12 and a relatively dense disk-shaped anchor 48 which is shown in greater detail in FIGS. 5–7.

Figure 5:
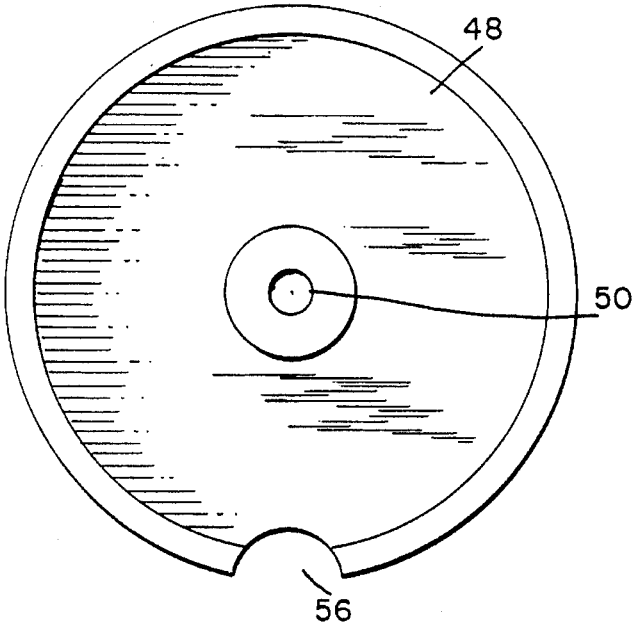
FIG. 5 is a top plan view of the anchor portion of the base.
Figure 6:
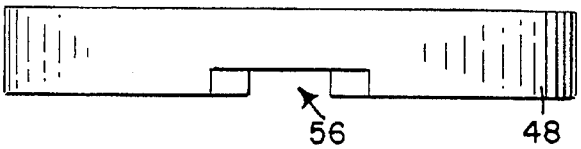
FIG. 6 is an elevational view of the anchor portion.
Figure 7:
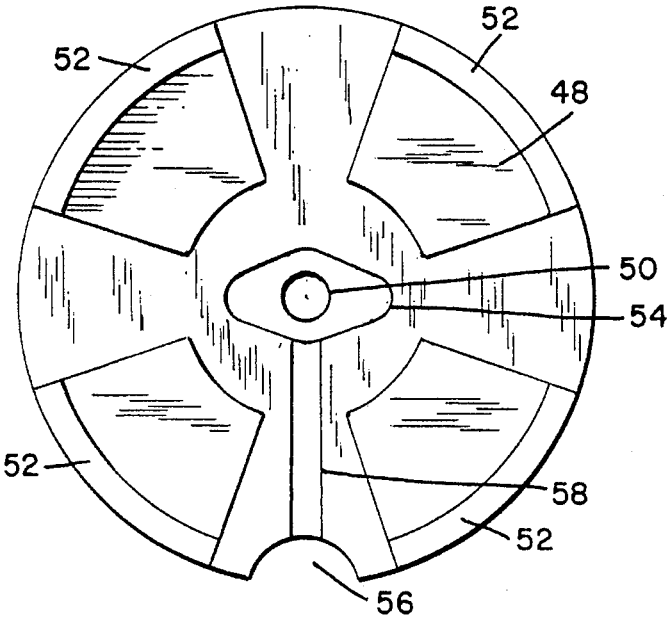
FIG. 7 is a bottom plan view of the anchor portion.

Referring particularly to FIGS. 5–7, the anchor 48 has a central bore 50 and a plurality of outer downwardly facing ridges 52. The under surface of the anchor 48 has a cavity 54 around the bore 50, a notch 56 at the periphery of the anchor and a groove 58 which extends from the cavity 54 to the notch 56.

Figure 10:
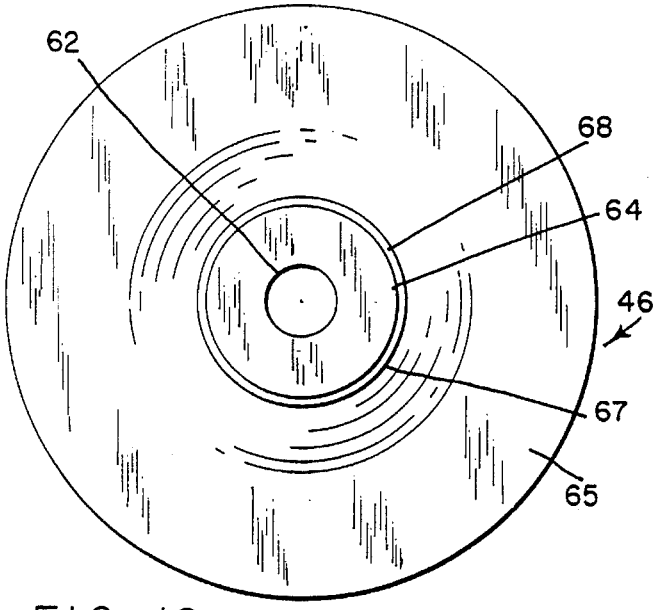
FIG. 10 is a top plan view of the housing portion of the base.
Figure 11:
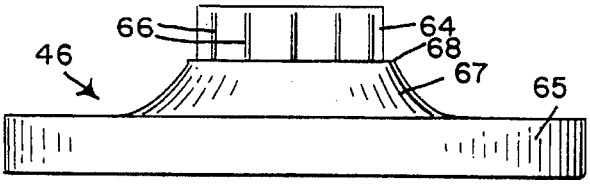
FIG. 11 is an elevational view of the housing portion of the base.
Figure 12:
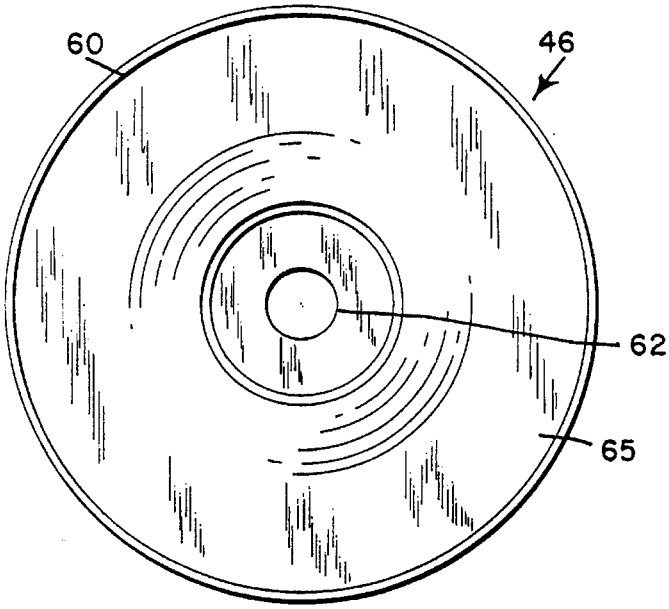
FIG. 12 is a bottom plan view of the housing portion of the base.

Referring particularly to FIGS. 10–12, the housing portion 46 of the base 38 has a disk-shaped bottom portion 65, an upwardly extending cylindrical upper portion 64 and a conical intermediate portion 67 which is located between the disk-shaped portion 65 and the upwardly extending cylindrical portion 64. The intermediate portion 67 has an annular upper surface 68 which extends around the upwardly extending cylindrical portion 64. The bottom portion 65 has a circular downwardly facing cavity 60 for receiving the disk-shaped anchor 48. The housing 46 has a central vertical bore 62 which is co-axial with the bore 50 of the anchor 48. The upwardly extending projection 64 has a plurality of small vertical ridges 66.

Figure 8:
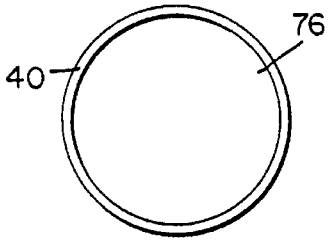
FIG. 8 is a top plan view of a cylindrical tube which forms part of the construction of the top assembly and of the bottom assembly.
Figure 9:
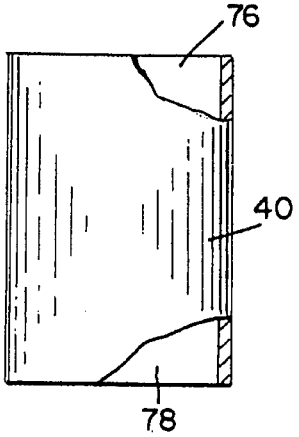
FIG. 9 is an elevational view of the cylindrical tube.

Referring to FIGS. 8 and 9, the lower body 40 is a cylindrical tube which is preferably made of cardboard and which has a top opening 76 and a bottom opening 78.

Figure 13:
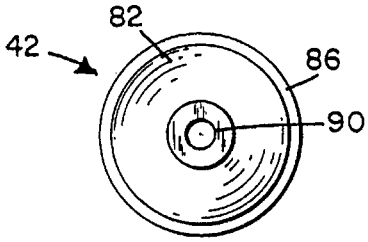
FIG. 13 is a top plan view of a coupler body which is a component of the top assembly and of the bottom assembly and which is used for connecting the top assembly and the bottom assembly to the main body.
Figure 14:
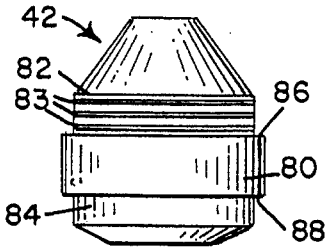
FIG. 14 is an elevational view of the coupler body.
Figure 15:
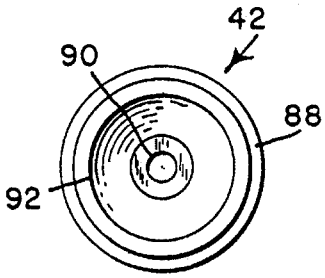
FIG. 15 is a bottom plan view of the coupler body.

Referring particularly to FIGS. 13–15, the first coupler 42 consists of a cylindrical mid-portion 80, a first projection 82 which extends from one end of the mid-portion 80 and a second projection 84 which extends from the opposite end of the mid-portion 80. The first coupler 42 is essentially hollow and has an opening 90 at the end of the first projection 82 and an opening 92 at the end of the second projection 84. The portion of each of the first and second projections 82 and 84, respectively, which are adjacent the mid-portion 80, is cylindrical, the outer diameter of which is less than the outer diameter of the mid-portion 80. The mid-portion 80 has an annular surface 86 which faces away from the second projection 84 and which surrounds the first projection 82. The mid-portion 80 has an annular surface 88 which faces away from the first projection 82 and which surrounds the second projection 84. The outer ends of each of the projections 82 and 84 are tapered inwardly. The cylindrical portion of the first projection 82 has a plurality of small annular ridges 83.

The bottom assembly 26 is assembled by placing the anchor 48 within the cavity 60 of the housing 65. The upwardly extending cylindrical projection 64 is inserted into the bottom opening 78 of the lower body 40 in a frictional telescopic fit. The outer diameter of the projection 64 is substantially equal to the inner diameter of the body 40 and the ridges 66 provide a tight fit. The lower edge of the lower body 40 rests on the upwardly facing surface 68 of the conical intermediate portion 67. The second projection 84 of the first coupler body 42 is inserted into the top opening 76 of the lower body 40 in a right telescopic fit. The outer diameter of the projection 84 is substantially equal to the inner diameter of the tube 40. The outer diameter of the mid-portion 80 is substantially equal to the outer diameter of the tube 40 so that when the second projection 84 is inserted within the top opening 76 of the lower body 40, the upper edge of the lower body 40 engages the annular surface 88. The elements of the bottom assembly 26 are held together as a unit by the tubular threaded rod 44 which extends through the center of all of the elements of the bottom assembly 26 so that the bottom end of the rod extends into the cavity 54 of the anchor 48 and the top of the rod extends above the first projection 82 of the first coupler 42. A first nut 70 is threaded onto the top end of the rod 44 and a second nut 72 is threaded onto the bottom end of the rod 44. A washer 74 is located between the nut 72 and the bottom surface of the anchor 48.

In another embodiment of the invention, a modified second nut is a flat plate which is shaped like the cavity 54 and which has a threaded central aperture. The modified second nut is positioned within the cavity 54.

In a still further embodiment of the invention, the nut 72 is permanently fixed to the anchor 48, preferably by being embedded in the anchor 48. The anchor 48 is preferably formed of a plastic outer shell which contains a high density material. The nut 72 is embedded in the shell of the anchor 48 during the molding process.

Figure 16:
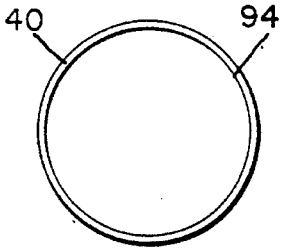
FIG. 16 is a top plan view of the main body portion of the lamp.
Figure 17:
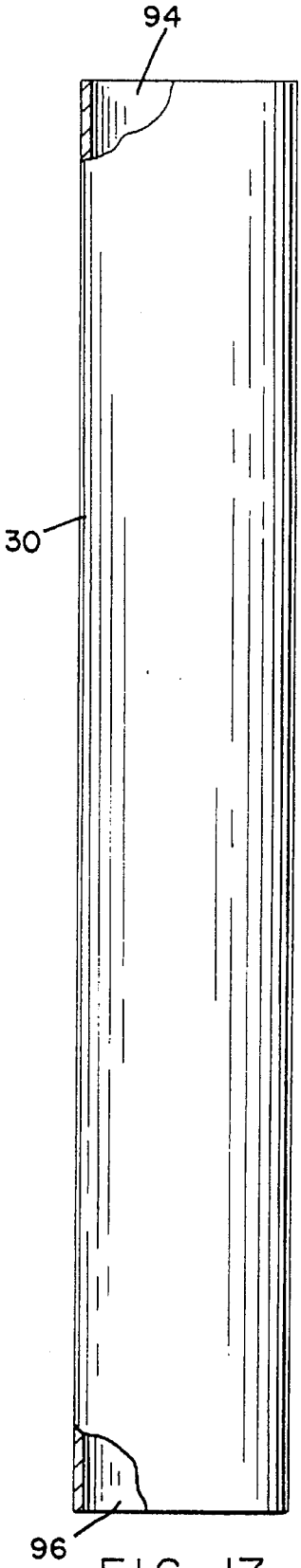
FIG. 17 is an elevational view of the main body.

Referring to FIGS. 16 and 17, the elongated main body 30 is a cylindrical tube which has a top opening 94 and a bottom opening 96. The main body 30 is positioned on the bottom assembly 26 so that the first projection 82 extends into the opening 96 in a tight telescopic fit. The outer diameter of the projection 82 is essentially the same as the inner diameter of the main body 30 and the ridges 83 provide a tight frictional fit. The housing 46 and the first coupler 42 are preferably made of plastic and the bodies 30 and 40 are preferably made of a softer material, such as dense rigid cardboard. The ridges 83 press into the softer cardboard material of the main body 30 to cream a tight connection between the first coupler 42 and the main body 30. However, the first coupler 42 can still be disconnected from the main body 30. When the first projection 82 is inserted into the opening 96 of the body 30, the lower edge of the body 30 engages the annular surface 86. The outer diameter of the mid-portion 80 is the same as the outer diameter of the bodies 30 and 40 so that the outer surfaces of the assembled bodies 40 and 30 and the first coupler 42 form a continuous cylindrical surface.

Figure 4:
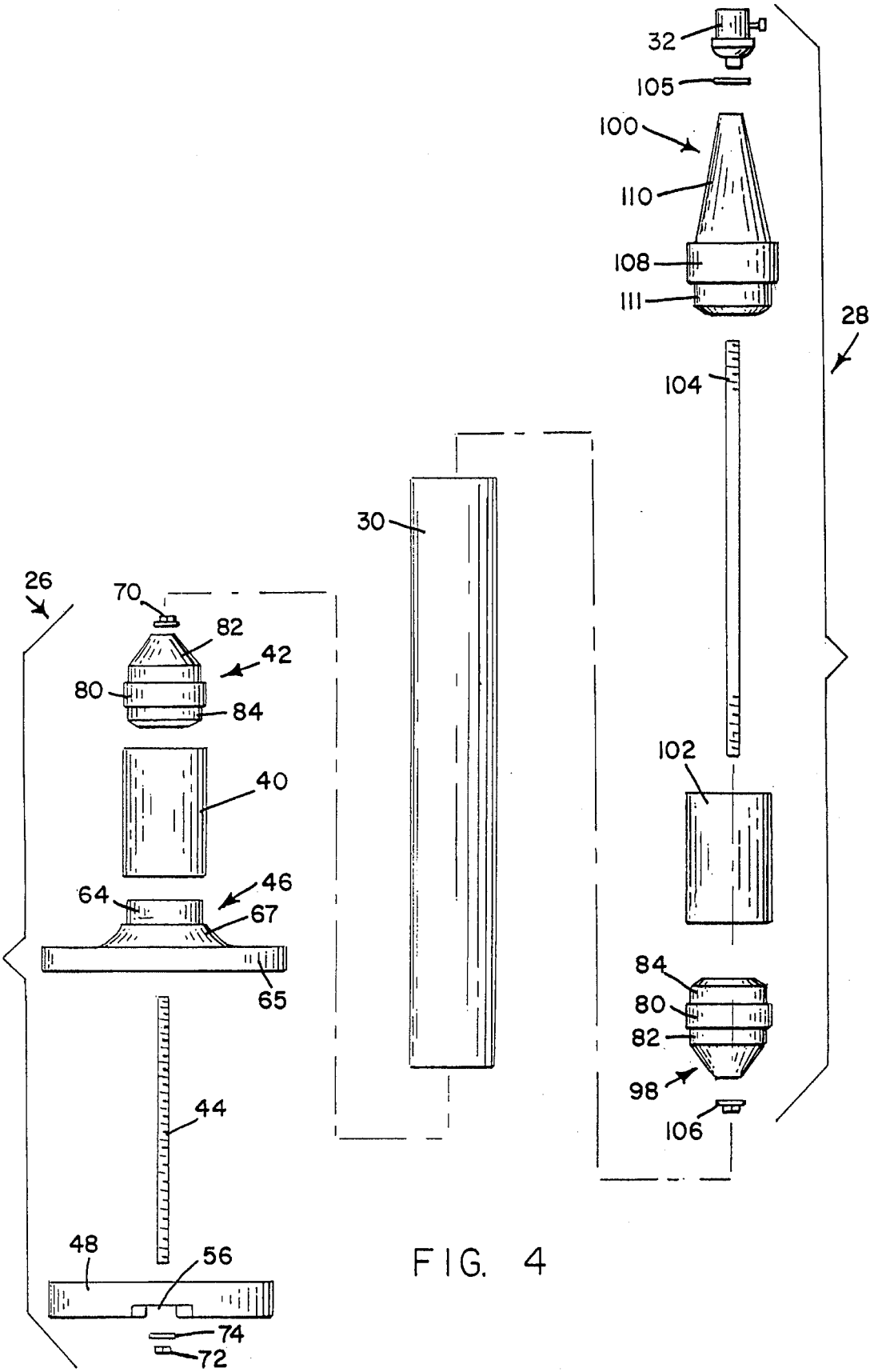
FIG. 4 is an exploded view of the lamp, showing all of the individual components of the lamp.
Figure 18:
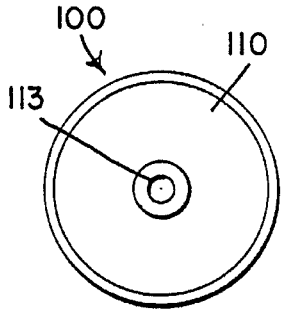
FIG. 18 is a top plan view of the cap portion of the top assembly.
Figure 19:
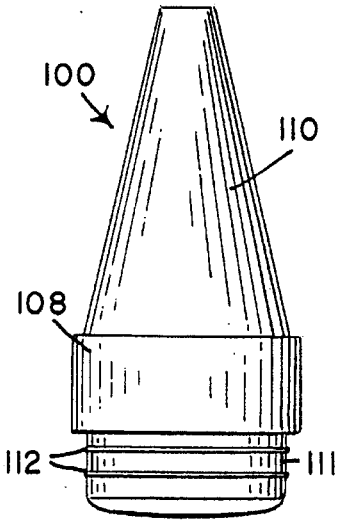
FIG. 19 is an elevational view of the cap.
Figure 20:
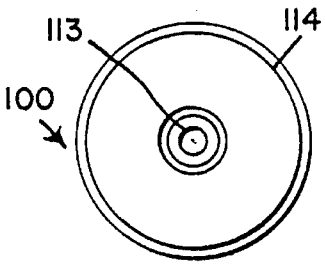
FIG. 20 is a bottom elevational view of the cap.

Referring particularly to FIG. 4, the top assembly 28 comprises a second coupler, generally indicated by the reference numeral 98, a cap generally indicated by the reference numeral 100, an upper body, generally indicated by the reference numeral 102 and tubular threaded rod 104. The second coupler 98 is identical to the first coupler 42. The upper body 102 is identical to the lower body 40. The threaded rod 104 is similar to the threaded rod 44 but is substantially longer. The cap 100 which is shown in greater detail in FIGS. 18–20 includes a cylindrical mid-portion 108, a frusto-conical upper projection 110 and a lower cylindrical projection 111. The cap 100 is generally hollow and has a top opening 113 and a bottom opening 114. The cap 100 is preferably made of a thermoplastic material and the upper body 102 is preferably made of a dense rigid cardboard.

The top assembly 28 is assembled by inverting the second coupler 98 relative to the first coupler body 42 so that the first projection 82 extends downwardly and the second projection 84 extends upwardly. The second projection 84 of the second coupler 98 is inserted into the bottom opening of the upper body 102 in a tight telescopic fit. The lower projection 111 of the cap 100 is inserted into the top opening of the upper body 102 in a tight telescopic fit. The threaded rod 104 is inserted through the middle of all of the elements of the top assembly 28 so that the lower end of the threaded rod extends below the second coupler 98 and the upper end of the threaded rod extends above the cap 100. A nut 106 is threaded onto the bottom end of the rod 104 and a conventional electrical fixture 32 is threaded onto the top end of the rod 104. A washer 105 is positioned between the top end of the cap 100 and the electrical fixture 32. The top assembly 28 is then coupled to the main body by inserting the first projection 82 of the second coupler 98 into the top opening 94 of the main body 30 in a right telescopic fit. Since the second coupler body 98 is identical to the first coupler 42, the outer diameter of the cylindrical mid-portion 80 of the second coupler has the same outer diameter of the main body 30. When the top assembly 28 is coupled to the main body 30, the outer surfaces of the bottom and top assemblies 26 and 28, respectively, and the main body 30 form a continuous outer cylindrical surface as shown in FIG. 1. Finally, the fixture 43 of the lamp shade 36 is screwed onto the electrical light fixture 32 to form a completed composite floor lamp. An electrical cord 115 extends from the light fixture 32 through all of the components of the floor lamp, including the rods 104 and 44, and exits the lamp beneath the anchor portion 48 of the base 38.

Figure 21:
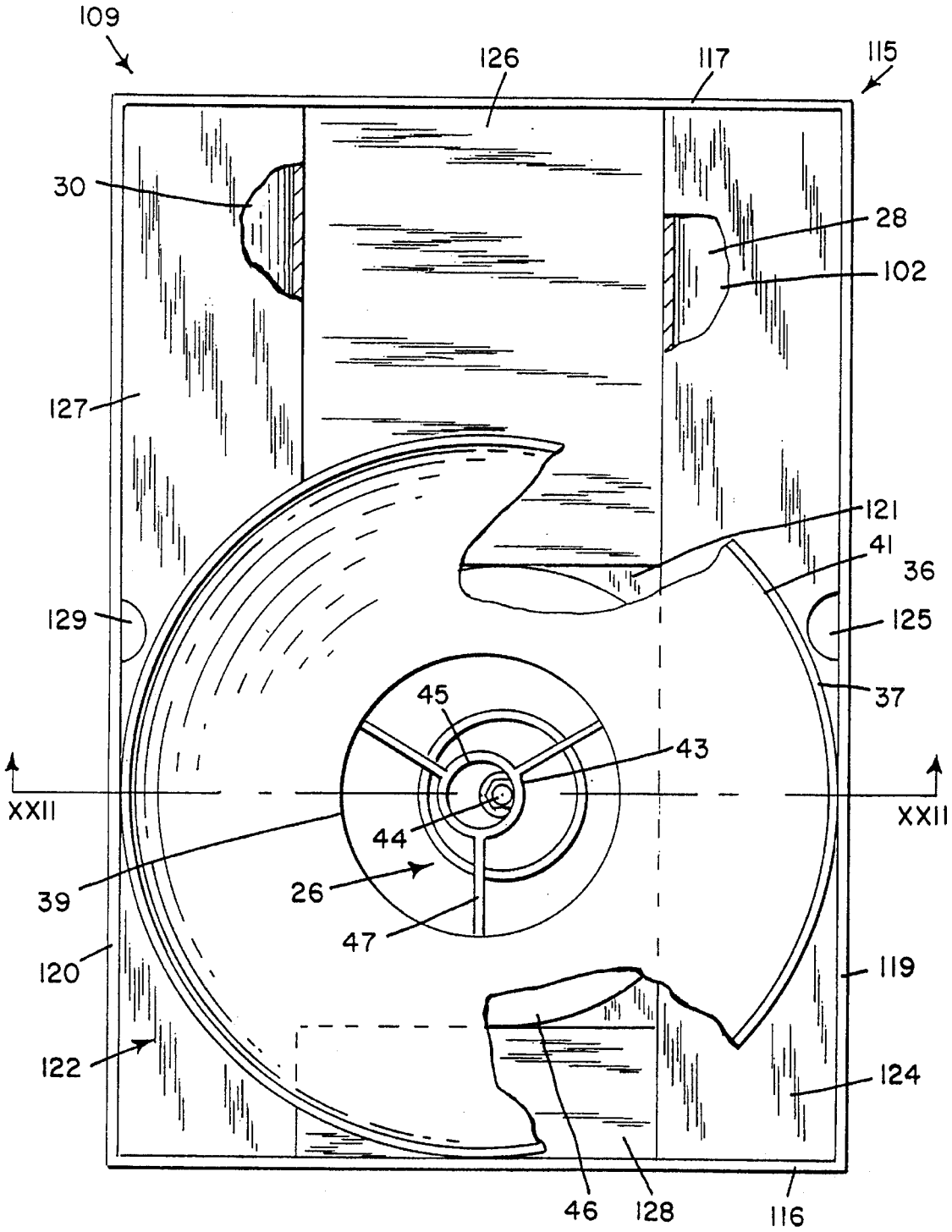
FIG. 21 is a top plan view of a composite floor lamp package which shows the components of the composite floor lamp packed in a box which is specifically designed for the composite floor lamp.
Figure 22:
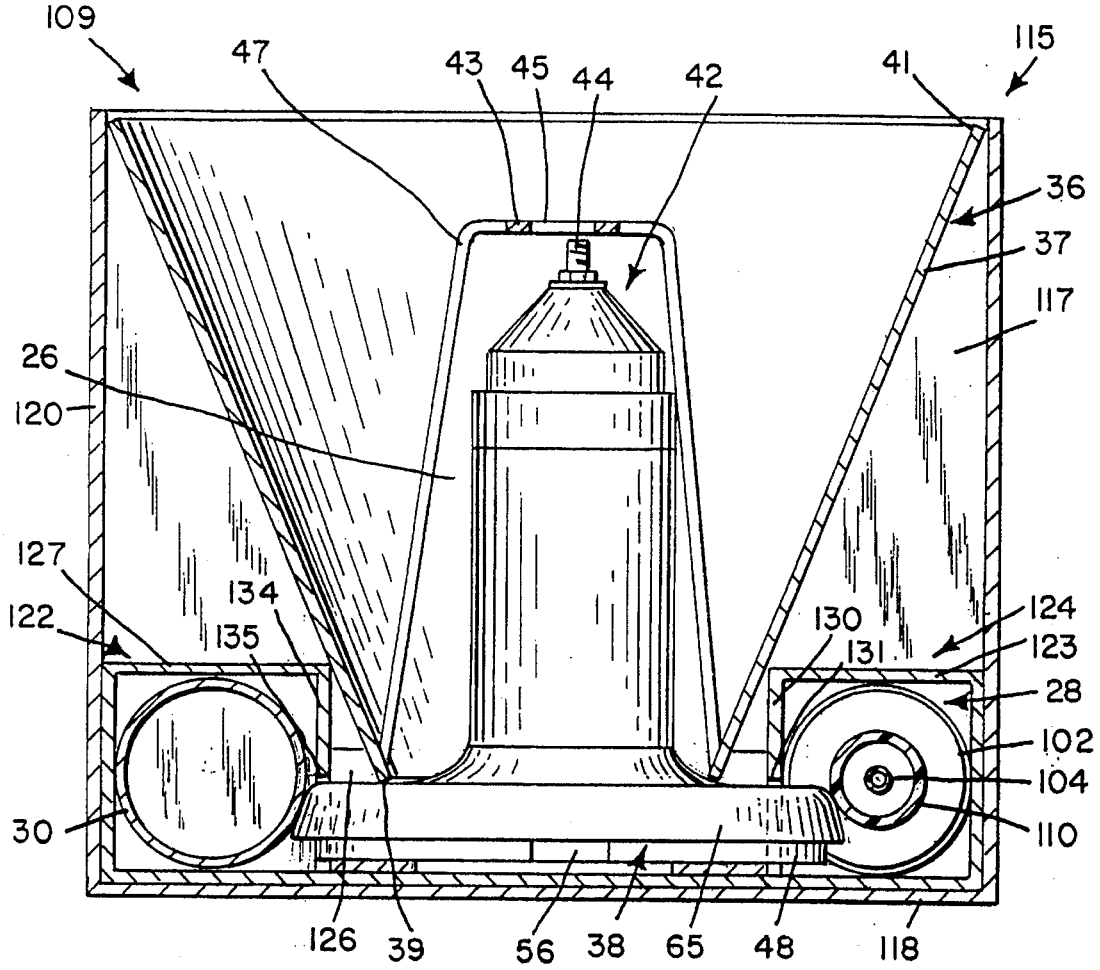
FIG. 22 is a vertical cross-sectional view of the composite floor lamp package taken along the line XII—XII of FIG. 21.

Referring to FIGS. 21 and 22, a shipping container for shipping the disassembled components of the composite floor lamp is generally indicated by the reference numeral 109 and includes a rectangular box which is generally indicated by the reference numeral 115. The box 115 comprises a front wall 116 and a back wall 117, a right side wall 119 and a left side wall 120 and a bottom wall 121. The usual top closure flaps are not shown for the sake of clarity. A shipping container 109 also includes a left inner partition 122, a right inner partition 124, a back spacer 126 and a front spacer 128. The right inner partition 124 includes a vertical side wall 130 which is spaced from the right side wall 119 of the box 115 and which contains an opening 131 adjacent the bottom wall of the box. The left inner partition 122 includes a vertical side wall 134 which is spaced from the left side wall 120 and which includes an opening 135 adjacent the bottom wall of the box. The right inner partition 124 has a top wall 123 which is spaced from the bottom wall of the box 115 and which contains a finger notch 125. The left inner partition 122 includes a top wall 127 which is spaced from the bottom wall of the box 115 and which contains a finger notch 129. The left and right partitions 122 and 124, respectively are formed from a single piece of bendable and foldable material such as cardboard. Each end of the material is formed into a rectangular loop to define the partitions 122 and 124.

Figure 2:
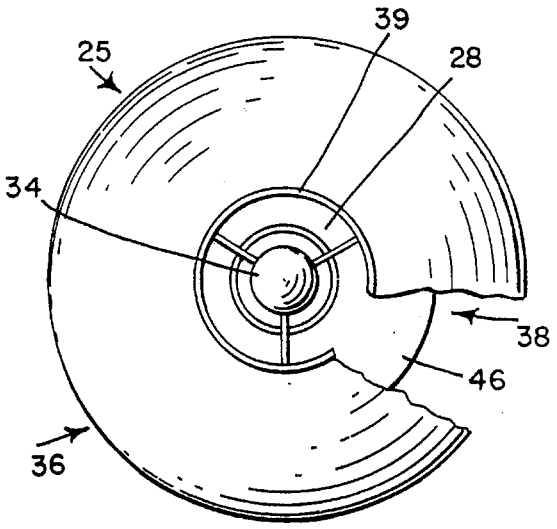
FIG. 2 is a top plan view of the lamp.
Figure 3:
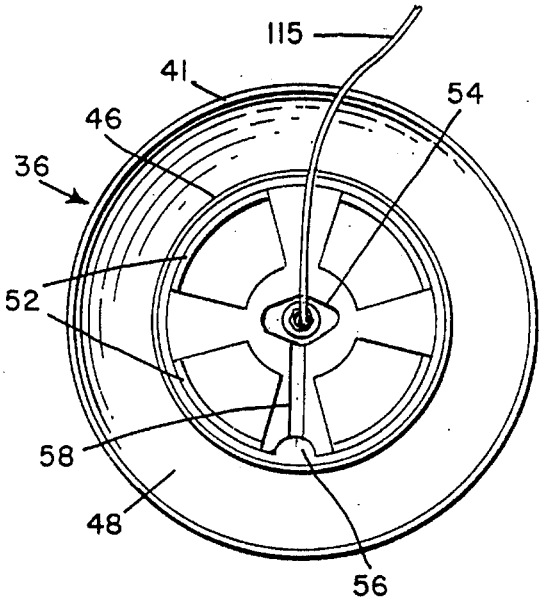
FIG. 3 is a bottom plan view of lamp.

The components of the composite lamp 25 are packed into the shipping container 109 by first opening the left end of partition 122 when inserting the main body 30 and, thereafter, closing the partition 122 as shown in FIG. 22. The top assembly 28 is inserted within the open partition 124, whereupon the partition 124 is closed to the position shown in FIG. 22. The bottom assembly 26 is positioned between the partitions 122 and 124 so that the base 38 is supported at the bottom of the box and part of the periphery of the base extends through the openings 135 and 131 as shown in FIG. 22. The base 38 also extends between the rearward end forward spaces 126 and 128, respectively as shown in FIG. 21. The openings 131 and 135 are just wide enough to permit the amount of penetration, as shown in FIG. 2, by the base 38 into the partitions 124 and 122, respectively. At the same time, the peripheral edges of the base 38 extend very close to the main body 30 and to the cap 110. The lamp shade 36 is placed within the box 115 in an inverted position so that the top end of the shade rests on the upper surface of the housing 65 and the lower body 40 and first coupler 42 extend upwardly within the frame work 47 of the lamp shade. The lower wide end of the lamp shade 36 extends to the top opening of the box and lies close to the front wall 116 and the side walls 119 and 120 as shown in FIG. 21. The lamp shade 36 is, thereby, restrained by the bottom assembly 26 and the partitions 122 and 124. Since all of the components of the lamp, including the lamp shade, are constrained, damage to the lamp shade is prevented during shipment. Also, the configuration and arrangement of the lamp components within the container 109 utilize a minimum amount of space, thereby requiring a box size which is unusually small, considering the volume of the lamp. The finger notches 125 and 129 enable to the partitions 124 and 122, respectively, to be lifted from the bottom of the box 115 for removal of the top assembly 28 and the main body 30 for assembly by the consumer. This step is preceded by removal of the lamp shade 36 and the bottom assembly 26.

Clearly, minor changes may be made in the form and construction of this invention and in the embodiments of the process without departing from the material spirit of either. Therefore, it is not desired to confine the invention to the exact forms shown herein and described, but it is desired to include all subject matter that properly comes within the scope claimed.

The invention having been thus described, what is claimed as new and desired to secure by Letters Patent is:

1. A composite floor lamp package comprising:

(a) a box having a bottom wall, a front wall, a back wall, a left side wall and a right side wall;

(b) a left inner partition at the intersection of the left side wall and the bottom wall of said box, said left inner partition defining a left inner compartment;

(c) a right inner partition at the intersection of the right side wall and the bottom wall of said box, said right inner partition being spaced from said left inner partition and defining a right inner compartment;

(d) a disassembled composite floor lamp comprising:

(1) an elongated main body having a top end and a bottom end, said main body being supported in a horizontal position within the left compartment of said left inner partition;

(2) an elongated top assembly which has a bottom end which is capable of being coupled to the top end of said main body and a top end for receiving a light bulb and a shade, said top assembly being supported in a horizontal position within the right compartment of said right inner partition;

(3) a bottom assembly having a disc shaped base and an elongated upper portion which is normal to said base which has a top end which is capable of being coupled to the bottom end of said main body, said base being supported in a horizontal position on said bottom wall between said left and right compartments so that the upper portion of said bottom assembly extends vertically; and (4) a lamp shade which has a frusto-conical outer wall having a relatively large diameter bottom end which has a relatively large diameter circular opening and a relatively small diameter top end which has a relatively small diameter circular opening, said lamp shade having a central fixture adjacent said wide opening for attachment to the upper end of said top assembly and a supporting framework which is fixed at one end to said central fixture and at its opposite end to the top end of said frusto-conical outer wall, said framework defining a channel from said narrow end of said outer wall to said central fixture for receiving the upper end of said top assembly when said lamp shade is in an inverted position so that the top end of the outer wall of said lamp shade is supported on said base and the outer wall of said lamp shade is between said left inner partition and the right inner partition.

2. A composite floor lamp package as recited in claim 1, wherein said left partition includes a side wall which is spaced from the left side wall of the box and which has a left opening adjacent the bottom wall of the box and, wherein said right partition includes a side wall which is spaced from the right side wall of the box and the side wall of said left partition, the side wall of said partition having a right opening adjacent the bottom wall of the box, the diameter of said disc shaped base being greater than the distance between the side walls of said left and right partitions so that a portion of the outer periphery of said base extends into each of said left and right openings.

3. A composite floor lamp package as recited in claim 2, wherein the diameter of the bottom end of said lamp shade is substantially equal to the distance between the left and right walls of said box, wherein the distance between the front and back walls of the box is substantially greater than the distance between the left and right side walls of the box and, wherein each of said left and right openings is closer to one of the front and back side walls of the box so that the bottom end of said lamp shade is adjacent the one of said front and back walls which is closest to said left and right openings

4. A composite floor lamp package as recited in claim 2, wherein each of said main body, said top assembly and the upper portion of said bottom assembly is cylindrical.

5. A composite floor lamp package as recited in claim 1, wherein said left and right partitions are fabricated from a single continuous piece of flat material which has a horizontal middle portion which lays on the bottom surface of the box and a loop at each end which forms said left and right partitions.

6. A composite floor lamp package as recited in claim 5, wherein said single piece of flat material is corrugated cardboard.

7. A composite floor lamp package as recited in claim 1, further comprising:

(a) a front spacer between the front wall of the box and the base of the composite floor lamp, and (b) a back spacer between the back wall of the box and the base of the composite floor lamp, said back spacer functioning in conjunction with said front spacer to restrict the front to back and the back to front movement of said base.

8. A container for a composite floor lamp as recited in claim 4, wherein the bottom assembly of the floor lamp includes a disc shaped base and, wherein said left partition includes a side wall which is spaced from the left side wall of the box and which has a left opening adjacent the bottom wall of the box and, wherein said right partition includes a side wall which is spaced from the right wall of the box and the side wall of said left partition, the side wall of said right partition having a right opening adjacent the bottom wall of the box, the diameter of said disc shaped base being greater than the distance between the side walls of said left and right partitions for enabling a portion of the outer periphery of the base of a lamp which is supported on said bottom wall between said left and right partitions to extend into each said left and right openings.

9. A container for a composite floor lamp as recited in claim 5, further comprising:

(a) a front spacer which is located adjacent the front wall of the box; and (b) a back spacer which is located adjacent the back wall of the box, said back spacer being spaced from said front spacer and functioning in conjunction with said front spacer for restricting the front to back movement and the back to front movement of the said base of a composite floor lamp which is positioned between said front and back spacers.

10. A composite lamp comprising:

(a) a bottom assembly comprising:

(1) a base;

(2) a coupler;

(3) a lower body which is located between said coupler and said base, said lower body having a telescopic connection with each of said coupler and said base, each of said base, said coupler and said lower body having a bore; and (4) an elongated fastener which extends through the bore in each of said base, said coupler and said lower body for clamping said lower body tightly to said base and to said coupler, (b) a top assembly for receiving a light bulb and a lamp shade;

(c) an elongated main body having a top end and a bottom end; each of said bottom assembly, said top assembly and said elongated main body having a conduit for enabling an electronic cord to extend through said lamp;

(d) first connecting means which forms part of said coupler for connecting said top assembly to the top end of said main body; and (e) second connecting means for connecting said bottom assembly to the bottom of said main body.

11. A composite floor lamp as recited in claim 10, wherein said base has an upwardly extending projection, said coupler has a downwardly extending projection and said lower body has a lower opening for receiving said upwardly extending projection and an upper opening for receiving said downwardly extending projection.

12. A composite floor lamp as recited in claim 11, wherein said first connecting means is a frictional telescopic connection between said elongated main body and said coupler.

13. A composite floor lamp as recited in claim 12, wherein said coupler has an upwardly extending projection and said elongated main body has a bottom opening for receiving the upwardly extending projection of said coupler.

14. A composite lamp comprising:

(a) a bottom assembly comprising:

(1) a base;
(2) a first coupler;
(3) a lower body which is located between said coupler and said base, each of said base, said coupler and said lower body having a bore; and
(4) a first elongated fastener which extends through the bore in each of said base, said coupler and said lower body for clamping said lower body tightly to said base and to said coupler, (b) a top assembly for receiving a light bulb and a lamp shade, said top assembly comprising;
(1) a cap;
(2) a second coupler;
(3) an upper body which is located between said second coupler and said cap, each of said cap, said upper body and said second coupler having a bore; and
(4) a second elongated fastener which extends through the bore in each of said cap, said second coupler and said upper body for clamping said upper body tightly to said cap and to said upper coupler;

(c) an elongated main body having a top end and a bottom end; each of said bottom assembly, said top assembly and said elongated main body having a conduit for enabling an electronic cord to extend through said lamp;

(d) first connecting means which forms part of said first coupler for connecting said top assembly to the top end of said main body; and (e) second connecting means which forms part of said second coupler for connecting said bottom assembly to the bottom of said main body.

15. A composite floor lamp as recited in claim 14, wherein said second elongated fastener comprises:

(a) an elongated tube which has a threaded upper end which extends beyond said cap and a threaded lower end which extends beyond said second coupler, said tube functioning as part of the conduit for said electrical cord;

(b) an electrical lamp socket which is threaded onto the upper end of the elongated tube of said second elongated fastener and which engages said cap; and (c) a nut which is threaded onto the lower end of the elongated tube of said second elongated fastener and which engages said second coupler.

16. A composite floor lamp as recited in claim 14, wherein said upper body has a frictional telescopic connection with each of said second coupler and said cap.

17. A composite floor lamp as recited in claim 16, wherein said cap has a downwardly extending projection, said second coupler has an upwardly extending projection and said upper body has a lower opening for receiving the upwardly extending projection of said second coupler and an upper opening for receiving the downwardly extending projection of said cap.

18. A composite floor lamp as recited in claim 17, wherein said second connecting means is a frictional telescopic connection between said main body and said second coupler.

19. A composite floor lamp as recited in claim 18, wherein said second coupler has a downwardly extending projection and said main body has a top opening for receiving the downwardly extending projection of said second coupler.

20. A composite floor lamp comprising:

(a) a base;

(b) a main body which is located above said base;

(c) a lower body which is located between said base and said main body;

(d) a cap which is located above said main body;

(e) an upper body which is located between said main body and said cap; and (f) coupling means for coupling said lower body to said main body and said base and for coupling said upper body to said cap and to said main body, said coupling means comprising:
(1) a first intermediate coupler for coupling said lower body to said main body;
(2) a second intermediate coupler for coupling said upper body to said main body;
(3) a lower coupler for coupling said base to said lower body; and
(4) an upper coupler for coupling said cap to said upper body, said upper coupler comprising:
(i) a downwardly extending projection which is fixed to said cap and which extends into a top opening of said upper body in a frictional telescopic fit;
(ii) a top portion which has a frusto-conical shape with the narrow end of the frustum at the top; and
(iii) a middle cylindrical portion which has the same diameter as said upper body, so that said floor lamp has the appearance of a large crayon.

21. A composite floor lamp comprising:

(a) an upper cylindrical tube which has a bottom opening and a top opening;

(b) a lower cylindrical tube which has a bottom opening and a top opening;

(c) a central cylindrical tube which is located between said upper tube and said lower tube, said central tube cylindrical tube having a bottom opening and a top opening;

(d) a lower coupler for coupling the top of said lower cylindrical tube to the bottom of said central cylindrical tube, said lower coupler having a first cylindrical projection for extending into the bottom opening of said central tube and a second cylindrical projection for extending into the top opening of said lower tube, said lower coupler being substantially harder than said central cylindrical tube;

(e) an upper coupler for coupling the bottom of said upper cylindrical tube to the top of said central cylindrical tube, said upper coupler having a first cylindrical projection for extending into the top opening of said central tube and a second cylindrical projection for extending into the bottom opening of said upper tube, said upper coupler being substantially harder than said central cylindrical tube;

(f) a base which is coupled to the bottom of said lower cylindrical tube, said base having an upwardly extending projection for extending into the bottom opening of said lower tube;

(g) a cap which is coupled to the top of said upper cylindrical tube; and (h) an outer cylindrical surface on the first projection of each of said lower and upper couplers which is provided with a plurality of annular ridges for enabling each of said lower and upper couplers to form a tight frictional fit with said central cylindrical tube.

22. A composite floor lamp as recited in claim 21, wherein said central cylindrical tube is made of cardboard and each of said lower and upper couplers are made of a thermoplastic material.

23. A composite floor lamp as recited in claim 22, wherein each of said upper and lower tubes are made of cardboard and said cap is made of a thermoplastic material.

* * * * *